US008068386B2

(12) United States Patent
Mosher

(10) Patent No.: US 8,068,386 B2
(45) Date of Patent: Nov. 29, 2011

(54) GOLF ROUND PACE REGULATOR

(76) Inventor: Ellen Mosher, Alexandria, VA (US)

( * ) Notice: Subject to any disclaimer, the term of this patent is extended or adjusted under 35 U.S.C. 154(b) by 421 days.

(21) Appl. No.: 12/068,574

(22) Filed: Feb. 8, 2008

(65) Prior Publication Data

US 2009/0069120 A1 Mar. 12, 2009

Related U.S. Application Data

(60) Provisional application No. 60/935,916, filed on Sep. 6, 2007.

(51) Int. Cl.
*G04B 47/00* (2006.01)
*G04B 19/00* (2006.01)
*A63B 69/36* (2006.01)

(52) U.S. Cl. ..... 368/10; 368/223; 473/131

(58) Field of Classification Search ..... 368/10, 368/107–109, 223, 296; 273/131, 409; 473/131, 473/407, 409

See application file for complete search history.

(56) References Cited

U.S. PATENT DOCUMENTS 1,064,770 A * 6/1913 Quinn ..... 368/295
3,316,709 A * 5/1967 Edwards ..... 368/27
4,067,186 A * 1/1978 Grohoski et al. ..... 368/294
4,303,243 A * 12/1981 Wolfe ..... 473/150
4,509,644 A * 4/1985 Kulick ..... 206/461
4,684,264 A * 8/1987 Paperno et al. ..... 368/283
4,945,523 A * 7/1990 Lam ..... 368/285
5,086,390 A * 2/1992 Matthews ..... 700/91
5,097,416 A * 3/1992 Matthews ..... 700/91
5,119,346 A * 6/1992 Henderson et al. ..... 368/109
5,216,641 A * 6/1993 Hoel ..... 368/10
5,335,212 A * 8/1994 Bartos ..... 368/107
5,357,487 A * 10/1994 Coleman, III ..... 368/10
5,386,990 A * 2/1995 Smith ..... 473/131
5,523,985 A * 6/1996 Nixon ..... 368/107
6,033,316 A * 3/2000 Nixon ..... 473/131
6,346,055 B1 * 2/2002 Rege ..... 473/409
6,646,958 B1 * 11/2003 Geiger ..... 368/10
7,347,619 B2 * 3/2008 Lee ..... 368/296
2003/0156499 A1 * 8/2003 Miller ..... 368/296

* cited by examiner

*Primary Examiner* — Vit Miska
(74) *Attorney, Agent, or Firm* — McGuire Woods LLP

(57) ABSTRACT

A Golf Round Pace Regulator timing device is shown and described. The invention, with a custom course specific face decal, illustrates the time allocated to each hole on the golf course to help golfers maintain a steady pace of play to complete the course in the time allotted by the golf course management. The golfer(s) are responsible for maintaining the same pace on the course as the pace of the invention's moving clock hand across the easy to read face decal. The invention solves the problem of slow play and decreased course revenue due to slow play. The invention solves the expensive customization manufacturing problem since it may be mass produced, and after manufacturing the customized course decal may be created and applied. The Invention is easy to implement and use on any golf course.

18 Claims, 4 Drawing Sheets

View of Back

View From Top

Custom Course Cling Static Decal Example

GOLF ROUND PACE REGULATOR

CROSS-REFERENCE TO RELATED APPLICATIONS

Reference to provisional patent application No. 60/935,916 filed Sep. 6, 2007.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Each golf course agent determines the amount of time golfers are given to complete the course. However, golf course agents do not provide golfers with the amount of time golfers are allocated for each hole on the course so golfers start playing the game slowly and never start a good pace to complete the course within the time allotment resulting in a bottleneck affect on the course termed "Slow Play". The purpose of the Golf Round Pace Regulator timing device is to enforce the course time allotment by providing a device capable of illustrating time allotted for each hole so golfers can easily monitor their pace of play by keeping the same pace of play as displayed on the Invention. This Invention will keep play at a steady pace to minimize congestion, delay and frustration on the course. By providing a device that golfers can use to maintain their pace of play, golf course management can now enforce the posted course time and restrict slow players from their golf course. Golf course management can stay on schedule to allow players to start play at their reserved tee times. Slow play results in reduced golfers on the course. With a regulated pace of play, golf course management can maximize players on the golf course, thereby improving golf revenues.

An earlier version of a timing system is disclosed in "System and Method of Timing Golfers on a Golf Course" by Wolfe, U.S. Pat. No. 4,303,243, issued Dec. 1, 1981. This system allows the users to determine whether or not they are playing according to a prescribed time limit for each hole, as well as comparing their playing pace to other groups on the course. The timers indicate whether the golfers played the preceding hole faster, slower, or equal to the predetermined playing time. Unfortunately, the device does not display the timing for a current hole, but rather the display is made on the succeeding tee box.

Another tracking method is the "System for Monitoring Play of a Golfer" of Mathews, U.S. Pat. Nos. 5,086,390 and 5,097,416, issued Feb. 4, 1992, and Mar. 17, 1992 respectively. This system utilizes transmitters positioned at the tees of each of the holes of the course to activate receivers carried by the golfers. The system also includes a means of notifying the course management of slow players. This device needs to be installed on the golf course.

The "Golf Clock" of Bartos, U.S. Pat. No. 5,335,212, issued Aug. 2, 1994, is another example of a programmable clock device. This device includes a digital display and is intended to be mounted on the user's golf cart. This device does not easily illustrate the time allotted each hole in order to maintain a steady course pace. Also, the device is not portable, so it cannot be used on a pull cart or golf bag for those players walling the course.

Accordingly, there have been many efforts made in terms of prior art devices that track and/or notify golfers of the pace of their play One such device is the "Variable Time Segment Pace Timing Device" of Coleman, U.S. Pat. No. 5,357,487, issued Oct. 18, 1994. The device includes a plurality of timing elements that can be programmed for the amount of time that the player desires to be allotted for each hole of the course. The timing can be varied to allow for changing conditions including number of players in a group and daylight hours available. The device is to be carried by at least one of the golfers. This device needs to be programmed with each use therefore human error jeopardizes the accuracy of the device.

Smith, U.S. Pat. No. 5,386,990 discloses Still another timing device is the "Golf Course Timing Method and System" of Smith, U.S. Pat. No. 5,386,990, issued Feb. 7, 1995. This device includes provisions for specifying the time to be allotted for each hole, for tracking the time of play, and for communicating the information to course personnel. The device is a series of moveable blades to be adjusted by the golf attendant therefore human error jeopardizes the accuracy of the device.

Another device to time play is the "Golf Course Timer to Alleviate Slow Play" of Nixon, U.S. Pat. No. 5,523,985, issued Jun. 4, 1996. This device is worn like a wristwatch by the golfer, and includes means to set the desired time to complete the round. The hour indicators of a normal wristwatch are replaced with the numbers of the holes of the golf course. A wristwatch device is a physical distraction for some when playing golf and is adjustable by the player not course management.

"The Golf Play Pacing Method" of Rege, U.S. Pat. No. 6,346,055 issued February 2002, is to provide a golf play pacing method that utilizes a device that is mounted directly in the flag sticks of the golf course and provides a pacing means that is dependent on the real-time playing interval for each hole relative to the pace on the course. This device needs to be installed on the golf course.

The prior art devices and methods for pacing are subject to one or more of the following shortcomings: First, the prior art assumes a willingness of the players themselves to adjust and activate the devices. Without golf course management controlling the devices, the players may readjust the device during play as needed.

Another drawback to prior art devices and methods is that they are dependent on the golf management manually adjusting each timer and monitoring each timer to ensure 18 moveable parts have not slipped out of place. With over 100 devices on the course, this is too tedious and human error can result in incorrect time allocations.

Another drawback to prior art devices and methods is that they are not easy to read, user friendly and do not encourage use. Display boards or clocks posted at tee boxes may be unnoticed by the golfers.

Another drawback to prior art devices and methods is they are permanently installed on golf courses and must be monitored and maintained by golf management to ensure not damaged by weather, lawn care devices and/or animals.

Another drawback to prior art devices and methods is they are complicated devices that actually spoil the golf game, therefore will not be used by golfers.

The invention is an effective, accurate, durable, and a tamperproof device for encouraging steady play on golf courses that is easy for the golf course management to implement, easy for the course starter to activate, easy to manufacture, easy to customize for each golf course, and easy for players to monitor their pace of play. The invention does not require timers at every tee or flag pole, complex electronic communications equipment, or a timer with 18 moving parts that need to be manually adjusted to be correct.

BRIEF SUMMARY OF THE INVENTION

Each golf course agent determines the amount of time golfers are given to complete the course. However, golf course agents do not provide golfers with the amount of time golfers are allocated for each hole on the course so golfers start playing the game slowly and never start a good pace to complete the course within the time allotment resulting in a bottleneck affect on the course termed "Slow Play". The purpose of the Golf Round Pace Regulator timing device is to enforce the course time allotment by providing a device capable of illustrating time allotted for each hole which is different for each (based on par, complexity, and so on) so golfers can easily monitor their pace of play by keeping the same pace of play as displayed on the Golf Round Pace Regulator. This invention may keep play at a steady pace to minimize congestion, delay and frustration on the course. By providing a device that golfers can use to maintain their pace of play, golf course management may now enforce the posted course time and restrict slow players from their golf course. Golf course management may stay on schedule to allow players to start play at their reserved tee times; And to avoid slow play that results in reduced golfers on the course. With a regulated pace of play, golf course management may maximize players on the golf course, thereby improving golf revenues.

The invention is an effective, accurate, durable, and a tamperproof device for encouraging steady play on golf courses that is easy for the golf course management to implement, easy for the course starter to activate, easy to manufacture, easy to customize for each golf course, and easy for players to monitor their pace of play. The invention does not require timers at every tee or flag pole, complex electronic communications equipment, or a timer with 18 moving parts that need to be manually adjusted to be correct.

The timer of the invention is a universal design that may be mass produced. After production, the custom course decal may be printed and applied. The invention may be customized for use on any course worldwide.

The uniqueness of the decal may be that it does not need glue or any other adhesive material to adhere to the invention. Once the invention has been produced, the decal may be printed with the course specific information, applied to the invention, and shipped to the course that may be used right out of the box.

The decal adheres to glass, so the glass surface protecting the invention from moisture, is where the decal may be applied. The invention may have a durable poly-carbonate top bezel that snaps to the glass bezel to protect the glass from breakage and prevents players from removing the decal.

The invention's timing mechanism may be configured to only be reset with a special key or instrument given to golf management. The key may reset the invention to the start position and cannot be partially reset to any other position. Once the invention has been reset, and the players have teed off, the starter starts the invention by pressing the start or activation button. The key may not be available to golfers in order to prevent tampering with the invention. Once the invention has started, golfers may not reset, adjust or stop it.

The invention may run on a battery. The battery compartment may only be opened with a special key or instrument given to golf management. Golfers may not have access to this key so they may not tamper with the power to stop the invention. At the end of the golf game, the invention may stop. To save power, the battery may not be in use when the invention is stopped.

The invention may be water resistant and may be capable of withstanding varying weather conditions to include but not limited to heat, cold, dampness, humidity, wind etc.

The invention may be tamper proof thereby guaranteeing consistency and reliability of the timing device, and performing as intended to provide golfers with a pace guide to keep on pace with posted golf course time.

The invention is easy to view, understand and use thereby ensuring golfers are aware of their pace on the golf course. The invention may be attached to a golf bag, pull cart, power cart and/or attached to the golfer or caddy.

The invention usage may be easy to implement on any course. The invention may not require expensive computers or monitoring systems to be implemented to use the device. The invention may not require equipment installed on golf course to transmit signals anywhere.

The invention enables golfers to maintain the posted pace of play thereby providing a more enjoyable game for all players. Golf course management that provides a course that is free from "slow play" may benefit from more tee times from golfers who don't like "slow play" courses.

BRIEF DESCRIPTION OF THE SEVERAL VIEWS OF THE DRAWING

The following drawings, which are incorporated in and constitute a part of the specification, serve to explain the principles of the present invention when they are taken together with the general description given above and the detailed description of the preferred embodiments given below. Moreover, the aforementioned objects and advantages of the present invention, as well as additional objects and advantages thereof, will become apparent when consideration is given to the following detailed description which should be read in conjunction with the following drawings wherein.

DETAILED DESCRIPTION OF THE INVENTION

Figure 1:
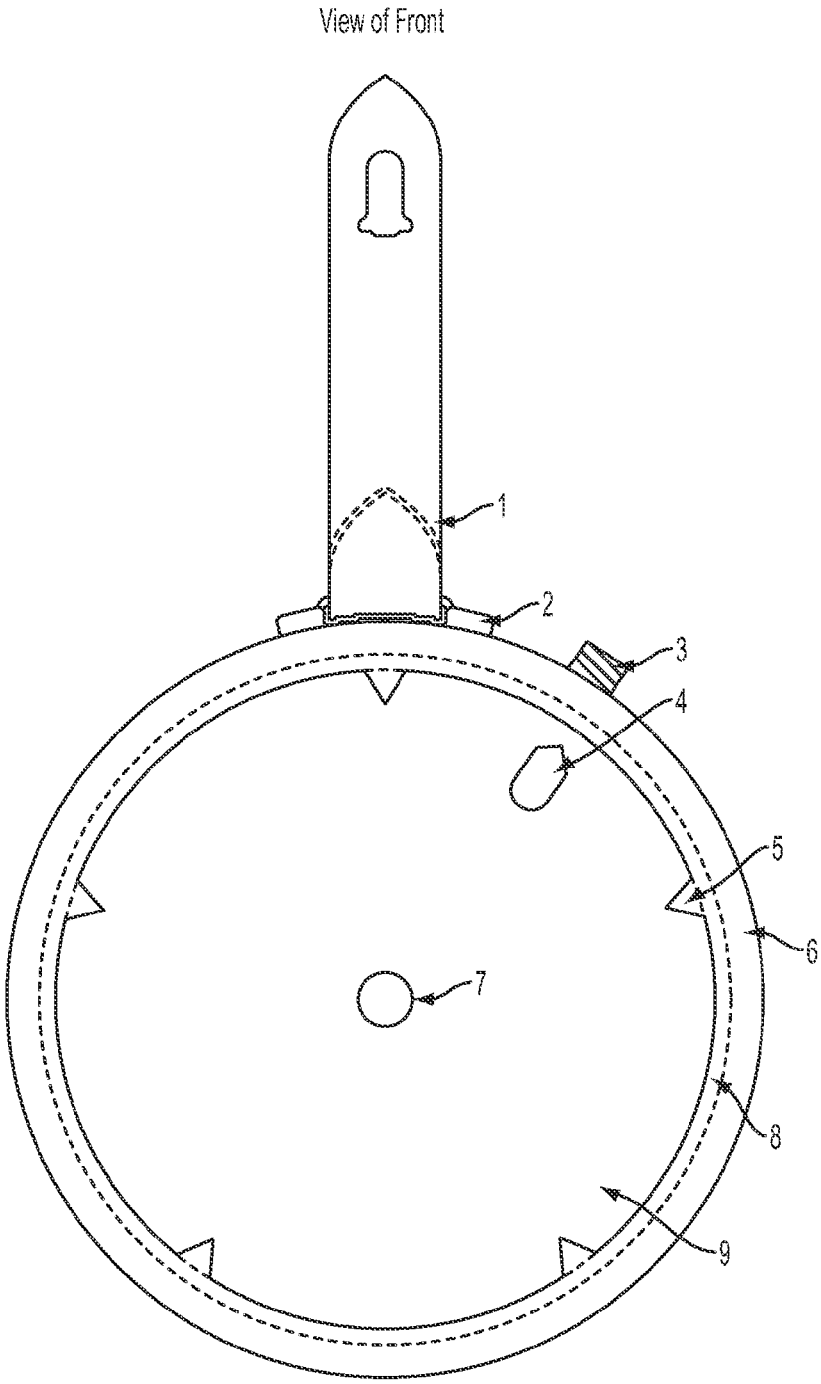
FIG. 1—View of the Front of the present invention
FIG. 2—View of the Back of the present invention
FIG. 3—View from the Top of the present invention
FIG. 4—Custom course cling static decal example

General Information and Using the Invention:

Referring to FIGS. 1-4, there are shown some, but not the only, embodiments of the invented golf round pace regulator. The invention is designed operate about 5 hours or 300 minutes then may stop automatically. The indicator 4 may make one revolution in that period, starting and stopping at the 12:00 position. The movement may be based on a clock movement that has been incorporated into a mechanical mechanism which then provides the needed functions. The invention may run on a battery 11, or the like which may be installed through a hatch on the back on the invention. See FIG. 2. The invention controls 10 may be operable with a custom key or the like, and it will be fairly difficult for a golfer to tamper with the invention once it has been started by the course attendant. The invention may be configured to be fairly water resistant. See FIG. 3. The cover 14 which may be glass may be sealed to the case 6 with a standard O-ring seal 15. The battery hatch 11 may also have a gasket. The lock 10 itself may not be water tight, but should be adequate to resist the entrance of rain etc. The invention may be configured to be mobile, have an independent power source, easy to implement on any golf course, tamperproof, and water resistant, As shown in FIG. 1, the Outward Appearance of the invention may be very streamlined. The dial 12 only shows the indicator 4 and the 5 hour markers 5. More markers may be added to further define the time increments—perhaps into 10 or 15 minute intervals. The marker shapes may be changed as well. The strap 1 may attach the invention to a bag, cart, pull cart, person or the like. The circle in the middle of the dial 7 represents the hub that carries the floating transparent disk 13 that has the indicator 4. It may be the same color as the dial, so what you would see of it would mostly be based on the shadow it might cast. From a distance it should blend in invisibly. The invention is easy to read, easy to follow, easy to understand, easy to attach to bag, pull cart, power cart, person or the like, and does not harm the golf course with permanently installed posts.

Figure 2:
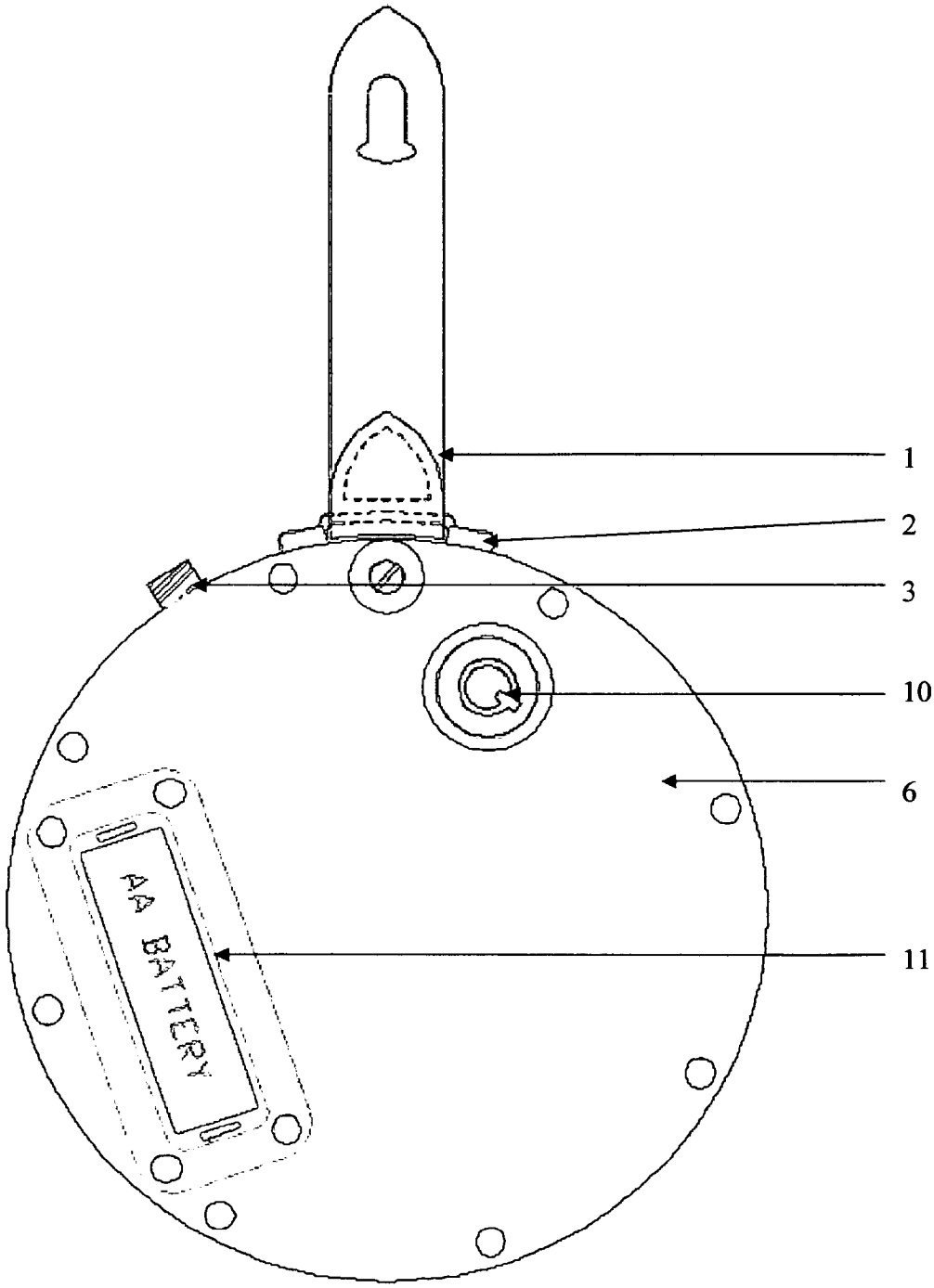

As shown in FIG. 2 the operation of the invention may be fairly consistent with regard to the steps taken by the course attendant to prepare and start the invention before transferring it to the golfer. The attendant may use a key to turn the lock 10 clockwise approximately 90 degrees. FIG. 1 At that point the indicator 4 may be returned to the 12:00 position and the start button 3 may pop out of the side of the case possibly at the 1:00 position viewed from the front. The key may then be turned back and removed. The key may only be removed when the lock is turned fully counter clockwise. The invention may now be ready for a round of golf. When the moment comes to start the invention, the attendant may push the button in 3. The button may push in until it is flush with the surface of the case, and it may remain there until released by the key at the beginning of the next cycle. These steps are the same every time regardless of the position of the floating indicator at the moment the key is inserted. If the invention is allowed to run the full five hours, it may stop itself at the 12:00 position by breaking the electrical contact between the quartz movement and the battery. The invention may be tamperproof and durable.

The key lock may use a tubular style key which may be removable in the counter clockwise position. The lock carries a steel cam provides the functions inside the invention. The tubular style key may withstand a great deal of twisting force, and may not be distorted over time as a flat key might. The locks may be available keyed alike, or keyed differently, or could be ordered in perhaps large lots each with a different key. Then a course may order as many as they like, and as long as the inventions are sent from the same lot, they may be keyed alike for the course attendant.

The Mechanical Function and Materials for Making the Invention:

In one embodiment, the use of the quartz movement may provide a simplified prototype design. It may be fully within the capabilities of current quartz analog technology to create all of these functions within a single compact movement, with all of the functions driven electronically and controlled by switches operation of the invention may be through a key lock with electrical contacts instead of a cam. During the manufacturing phase, the measurements and materials of the invention may be modified.

As shown in FIG. 1, the case 6, cover bezels 15 and 18, and button 3 may be black acetal plastic. However, any type of rigid plastic that is tough and impact resistant is contemplated by the invention. The overall case 6 diameter may be 5 inches. The case 6 may be finished with a 'brush' finish—grain running around the circumference on the sides and concentric circles on the back.

Figure 3:
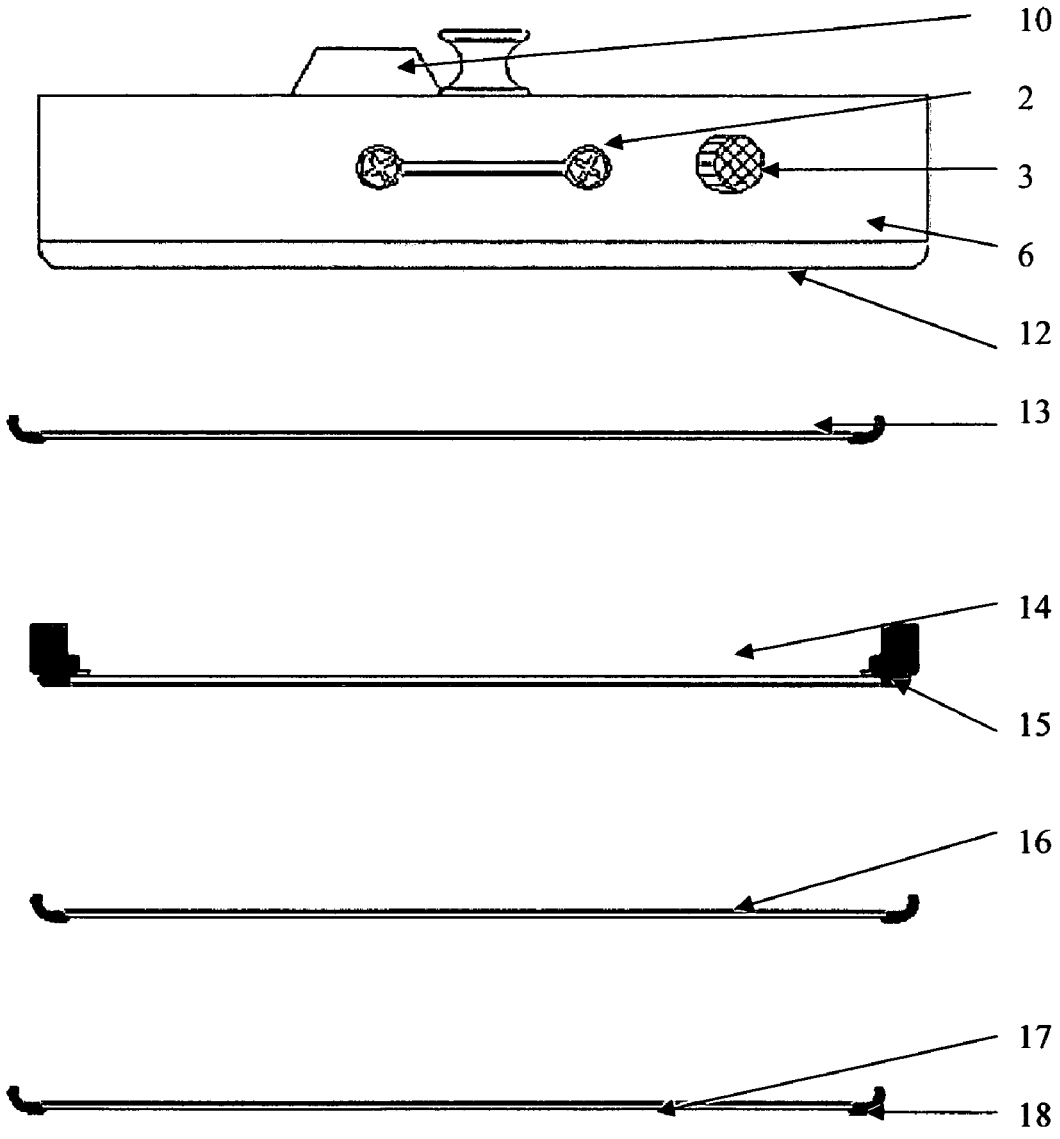

As shown in FIG. 3, there may be an outer cover 17 that may be formed of glass and may be 0.040" thick and may be clear poly-carbonate plastic. It may be shatter proof, providing protection for any glass layer underneath 14 as well as providing containment should that layer shatter. The poly-carbonate layer 17 may be carried by a bezel 18 that may snap onto the bezel 15 that carries the glass 13. Removal of the top poly-carbonate layer may require the use of a custom tool to wedge the bezel off. A "V" groove at the seam may be the tool, and the snap action may be made such that only moderate force is required to release it.

Figure 4:
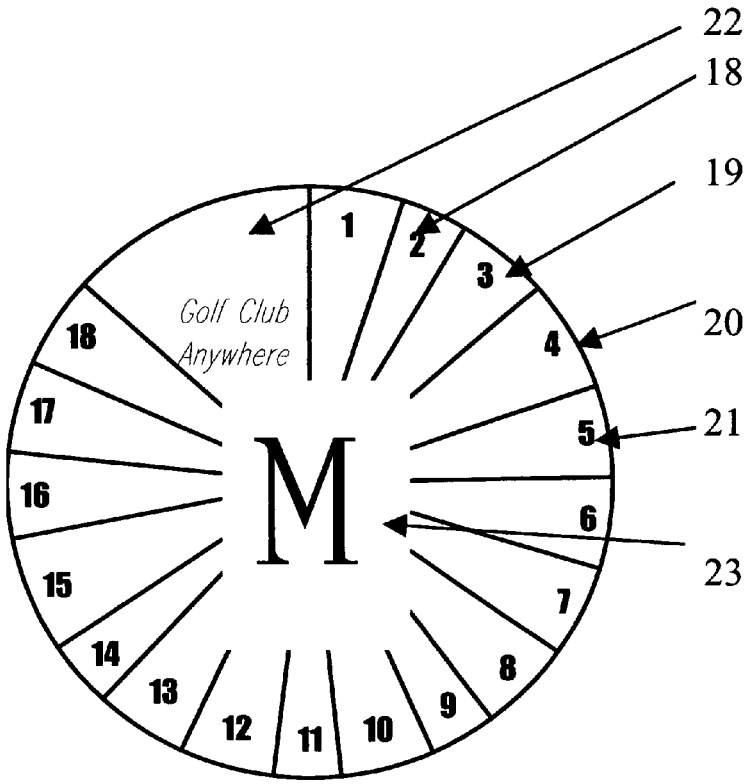

As shown in FIG. 3, the custom course decal 16 may be placed on the glass cover 14, then may be protected with the top cover poly-carbonate cover 17. FIG. 4 shows the custom course decal example illustrating the time allocated for each hole on the golf course may be placed on the cover glass 14 FIG. 3. The decal may be the only piece of the invention not made during the manufacturing phase. The decal may be placed on the invention for each course AFTER the manufacturing phase. This may enable the manufacturer to mass produce the invention cost effectively. Once a golf course has placed on order for their invention, the custom course decals may be designed, printed, placed on each invention, and sent to the golf course ready to be used.

As shown in FIG. 4, in the invention decal, the invention face may be divided into approximately 19 wedges 21. This example may be based on the invention having a time limit of 300 minutes or 5 hours. The invention may not be limited to 300 minutes or 5 hours. A golf course consists of 9 or 18 holes and each hole assigned a degree of difficulty to determine the amount of time allocated to complete each hole: For example, degree of difficulty, or par 3, may be allocated 14 minutes to play 18, a par 4 may be allocated 16 minutes to play 19 and a par 5 may be allocated 18 minutes to play 20. Each wedge on the decal may be sized to represent the time allocated to complete each hole: 14 minutes 3 18, 16 minutes 19 or 18 minutes 20. Each wedge corresponds to a hole on the golf course. Each hole on the golf course may be numbered 1 through 18 or 1 through 9. The decal may begin with wedge 1 at the 12:00 position and proceed in numerical order through wedge 18 or the $18^{th}$ hole or 9 or the $9^{th}$ hole. Golf course management may assign the par, degree of difficulty and the playing time for each hole and the decal indicates the time allocated for each hole with wedges widths on the decal that may equal 14 minutes, 16 minutes, 18 minutes or the like. Other time amounts are contemplated that may address other factors such as course complexity. To make it easy for the golfers to follow, the hole numbers 21 may be listed on each wedge. The clock hand indicator 4 rotates clockwise around the decal, starting at the 12:00 position and ending at the 12:00 position. Excess space 22 after wedge 18 or $18^{th}$ hole, or after wedge 9 or the $9^{th}$ hole, and before the clock hand returns to the 12:00 position, may be used for a course logo 22. The space in the center 23 may be used for another logo.

As shown in FIG. 3, the inner cover glass 14 may be 0.050" thick plate glass. The thin glass may reduce the weight of the invention quite a bit, and may increase visibility of the dial. This cover may be carried by a second, larger bezel 15. The bezel may slide over a standard O-ring and/or may be fastened in place using screws which may be inserted from the back. It may be removable for service of the invention should that be needed, but may not be convenient to do while out on the course. The bezel may create an effective viewable diameter of the dial that may be approximately 4 5/16 inches.

As shown in FIG. 1 and FIG. 3, the indicator may be a color such as red 4 that may be painted onto the surface of a 0.01" thick polycarbonate disk, or any other appropriate surface 13.

The disk may be thin to reduce the load being driven by the clock movement. It may also improve visibility. The outer edge of this disk may rotate under a recess in the glass bezel. By covering the outer edge of the transparent disk, the disk may be nearly invisible from the front, and this may cause the indicator to appear to float above the dial 12. The use of the disk may remove the need for any sort of stick style hand which could obviously be carried by a center hub. The transparent disk may be mounted on a plastic hub 7 which may be the same color as the dial. This may make the hub less noticeable.

The dial 12 may be 1/32 to 1/16" thick plastic that may include white acetal plastic, or an outdoor grade of any type of plastic or durable material. The dial may be a solid low sheen surface. The surface may contain a logo.

The invention may also include an attachment structure. In one embodiment the invention may use a strap. The strap 1 material itself may be leather with a loop sewn into the anchored end, or it may be rubber, perhaps neoprene or polyurethane, in which case the loop may be cemented. The free end may be provided with a keyhole shaped hole which is may be sized to fit the post on the back of the case. The loop may be sized with enough slack to allow the insertion of the strap bail and post 2. This may allow the strap to be removed and replaced as needed due to wear. The strap bail and post 2 may be stainless steel and may be attached to the case with stainless steel screws. The Invention may be carded by individual golfers and/or carried on golf carts and/or carried on the golf bag and/or pull-cart being used by the golfer(s).

Golfers may be advised that they must complete their golf game during within the allotted game time or face excessive penalty fees and/or be banned from playing the course for a specified amount of time all determined by the golf course management.

The Invention provides a consistent and impersonal "authority" for the control of play and may give a course marshal information upon which to base fair and consistent decisions about asking players to play faster to keep pace with the Invention.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A golf round pace regulator timing device for use by golfers and golf course agents to indicate an amount of time allocated to play each hole by golf course management in order for golfers to complete an entire course at a steady pace in a time allotted by the golf course management, the golfers are then responsible for keeping pace on the course responsive to the timing device, the golf round pace regulator comprising:

a timing mechanism to measure passage of time;

a timer dial connected to the timing mechanism, the timer dial comprising a rotating indicator, a first surface, and a second surface;

a starting means connected to and cooperating with the timing mechanism, the starting means accessible only with key or instrument by the golf course attendant for resetting the timer dial and starting operation of the timing mechanism to coincide with the golfers start of play, the starting means configured to prevent operation by the golfer;

a decal comprising course hole markings, the decal located on the first surface of the timer dial and covered with the second surface, the decal configured to indicate the hole of the golf course that the golfer should be playing at the time measured by the timing mechanism; and the rotating indicator comprising a clear disk configured to be driven by the operation of the timing mechanism and an indicator located near the periphery of the clear disk, the indicator configured to point to at least one of the course hole markings on the decal, the rotating indicator configured to complete at most one complete rotation in a period of time allocated to complete an entire golf course.

2. The golf round pace regulator as set forth in claim 1, wherein the course hole markings comprise a plurality of wedge-shaped indicia arranged on the decal, each hole marking corresponding to an individual golf course hole such that the rotating indicator is configured to point to each hole marking at a time the golfer should be playing the corresponding golf course hole.

3. The golf round pace regulator as set forth in claim 1, further comprising an o-ring configured to seal the first surface.

4. The golf round pace regulator as set forth in claim 1, wherein all components of the golf round pace regulator except the decal are configured to be mass produced, and the decal is configured to be customized for a specific golf course.

5. The golf round pace regulator as set forth in claim 1, further comprising a strap configured to removably attach the golf round pace regulator to an external structure.

6. The golf round pace regulator as set forth in claim 1, wherein the first surface is transparent, and the second surface is transparent.

7. The golf round pace regulator as set forth in claim 1, wherein the first surface is a glass surface.

8. The golf round pace regulator as set forth in claim 1, wherein the second surface is a durable poly-carbonate plastic surface.

9. The golf round pace regulator as set forth in claim 1, wherein the period of time is 5 hours.

10. The golf round pace regulator as set forth in claim 2, wherein the wedge-shaped indicia are different sizes, and the size of each wedge-shaped indicia is proportional to an amount of time allocated to play the hole to which the wedge-shaped indicia corresponds.

11. A timer for indicating the time allocated for each hole on a golf course, the timer comprising:

a timing mechanism to measure passage of time;

a dial connected to the timing mechanism, the dial comprising a first surface and a second surface;

a starting means connected to and cooperating with the timing mechanism, the starting means accessible only with key by a golf course attendant for resetting the dial and starting operation of the timing mechanism to coincide with a golfer's start of play, the starting means configured to prevent operation by the golfer;

a decal with course hole markings located on the first surface and covered with the second surface, the decal configured to indicate a hole of the golf course that a golfer should be playing at a time measured by the timing mechanism; and a rotating clock hand indicator comprising a clear rotating disk and an arrow located near the perimeter of the disk, the arrow configured to point to the course hole markings on the decal, the rotating clock hand indicator configured to be driven by the operation of the timing mechanism to point to at least one course hole marking on the decal, the rotating clock hand indicator further configured to complete at most one complete rotation in a period of time allocated to complete an entire golf course.

12. The timer as set forth in claim 11, wherein the course hole markings comprise a plurality of wedge-shaped indicia arranged on the decal, each hole marking corresponding to an individual golf course hole such that the rotating clock hand indicator points to each hole marking at a time when the golfer should be playing the corresponding golf course hole.

13. The timer as set forth in claim 11, further comprising an o-ring configured to seal the first surface.

14. The timer as set forth in claim 11, wherein all components of the timer except the decal are configured to be mass produced, and the decal is configured to be customized for a specific golf course.

15. The timer as set forth in claim 11, further comprising a strap configured to removably attach the timer to an external structure.

16. The timer as set forth in claim 11, wherein the first surface is transparent, and the second surface is transparent.

17. The timer as set forth in claim 11, wherein the first surface is a glass surface.

18. The timer as set forth in claim 11, wherein the second surface is a durable poly-carbonate plastic surface.

* * * * *